US005161264A

United States Patent [19]

Dugas

[11] Patent Number: 5,161,264

[45] Date of Patent: Nov. 10, 1992

[54] ABOVE-GROUND SWIMMING POOL

[76] Inventor: Gerald Dugas, 35 Hawthorne, Aylmer, Quebec, Canada, J9H 3Y2

[21] Appl. No.: 638,561

[22] Filed: Jan. 8, 1991

[51] Int. Cl.[5] ..... E04H 4/00

[52] U.S. Cl. ..... 4/506; 4/488

[58] Field of Search ..... 4/506, 488, 494, 510, 4/511, 512; 52/589, 585, 360, 169.7; 292/DIG. 49

[56] References Cited

U.S. PATENT DOCUMENTS

| | | | |
|---|---|---|---|
| 2,681,483 | 6/1954 | Morawetz | 52/585 |
| 2,839,762 | 6/1958 | Nomura | 4/488 |
| 3,193,847 | 7/1965 | Mashura | 52/247 |
| 3,302,825 | 2/1967 | Schleeweiss | 220/611 |
| 3,439,362 | 4/1969 | Goettl | 4/506 |
| 3,486,289 | 12/1969 | Lavack | 52/247 |
| 3,562,822 | 2/1971 | Wall | 4/506 |
| 3,874,132 | 4/1975 | Mendelow et al. | 4/488 |
| 4,124,907 | 11/1978 | Laven | 4/506 |
| 4,830,413 | 5/1989 | Bisbing | 292/DIG. 49 |

FOREIGN PATENT DOCUMENTS

| | | |
|---|---|---|
| 60627 | 4/1968 | Fed. Rep. of Germany . |
| 1559177 | 6/1969 | Fed. Rep. of Germany . |
| 2144195 | 3/1973 | Fed. Rep. of Germany . |

*Primary Examiner*—Henry J. Recla
*Assistant Examiner*—David J. Walczak
*Attorney, Agent, or Firm*—Samuel Meerkreebs

[57] ABSTRACT

An above-ground frameless pool includes an elongated continuous base with a groove and a flexible sheet metal wall extending along the groove and being joined end to end to form a continuous wall. A coping extends about the top edge of the flexible wall, and the coping is an endless rigid member having a deep groove for receiving the top edge of the wall member in a snug manner in order to provide stability to the structure.

6 Claims, 4 Drawing Sheets 16
17b
34
30
34
32
42
32
44
42
42
46
38
40
17a
30
34
42
32
32
36
38
40
14
12
19b
20
22
19a
16
4
17
42
34
30
42
42
42
32
36
46
32
4
38
5
5
40
18
14
14
22
12
19

ABOVE-GROUND SWIMMING POOL

BACKGROUND OF THE INVENTION

1. Field of the Invention

The present invention relates to a swimming pool, and more particularly, to an above-ground pool.

2. Description of the Prior Art

Above-ground pools typically have a continuous base with a groove for receiving a flexible sheet metal wall which has a seam joining the wall end to end. Spaced-apart vertical posts or rigid ribs extend upwardly from the base, and a continuous coping sits on the posts to receive the top edge of the wall. A plastic liner covers the ground and the interior of the wall to provide a leak-proof reservoir. The wall is, in fact, held stable by means of the frame formed by the base, posts, and coping. These structures have stood the test of time and are extremely popular.

Such pools are usually marketed as do-it-yourself projects, but, because of their size and number of parts (almost two hundred fasteners), the installation thereof can tax even a professional installation crew. It has been the aim of designers in recent years to at least reduce the number of parts in order to simplify the installation of such pools. It is evident that if the posts were eliminated, many such parts would be eliminated.

Mashura U.S. Pat. No. 3,193,847, 1965, is one such attempt. However, Mashura utilizes rigid steel wall segments placed on a base. The Mashura solution is not practical for most applications since the handling of large rigid steel wall segments and the tie rods may not be practical from the shipping and handling point of view.

Schleeweiss, U.S. Pat. No. 3,302,825, 1967, suggests a flexible metal side wall strip formed with parallel ribs, without a base (other than a reinforced but flexible bottom edge), and a coping which may be flexible. It is evident that any force exerted on one segment of the flexible wall and coping could cause wave motion to be built up in the water contained in the reservoir, and ultimately the walls could collapse as a result of the movement of the water on the flexible wall.

SUMMARY OF THE INVENTION

It is an aim of the present invention to provide an above-ground pool which is simple in construction and is an improvement over such known pools.

It is a further aim of the present invention to provide an above-ground pool having a flexible side wall but without posts, yet avoiding the inherent disadvantages of the above-mentioned prior art.

A construction in accordance with the present invention comprises an above-ground pool having a continuous base member defining a wall receiving groove, a continuous wall formed from an elongated flexible tensile strong strip having a seam extending vertically at the ends of the strip when the wall is assembled on the base, and a continuous rigid coping member including a continuous groove for receiving the top edge of the wall in a snug manner whereby the coping provides stability to the assembled pool.

DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
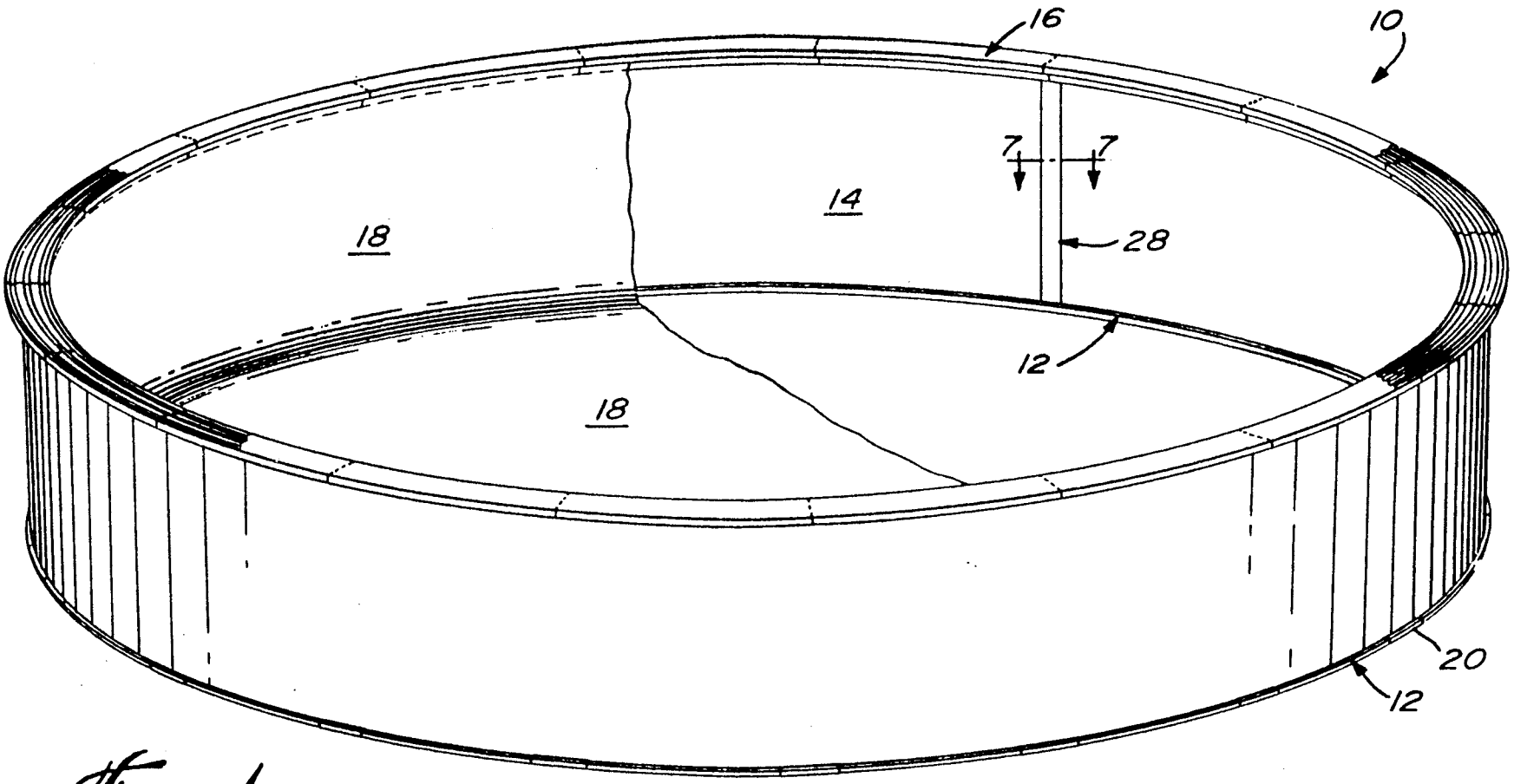
FIG. 1 is a perspective view of an above-ground swimming pool in accordance with the present invention.

As shown in FIG. 1, there is an above-ground swimming pool 10 having a base 12 on which is mounted a continuous wall 14, a coping 16, and a liner 18 covers the interior of the wall 14 and the ground surface on which the above-ground pool 10 is erected.

Figures 2, 3:
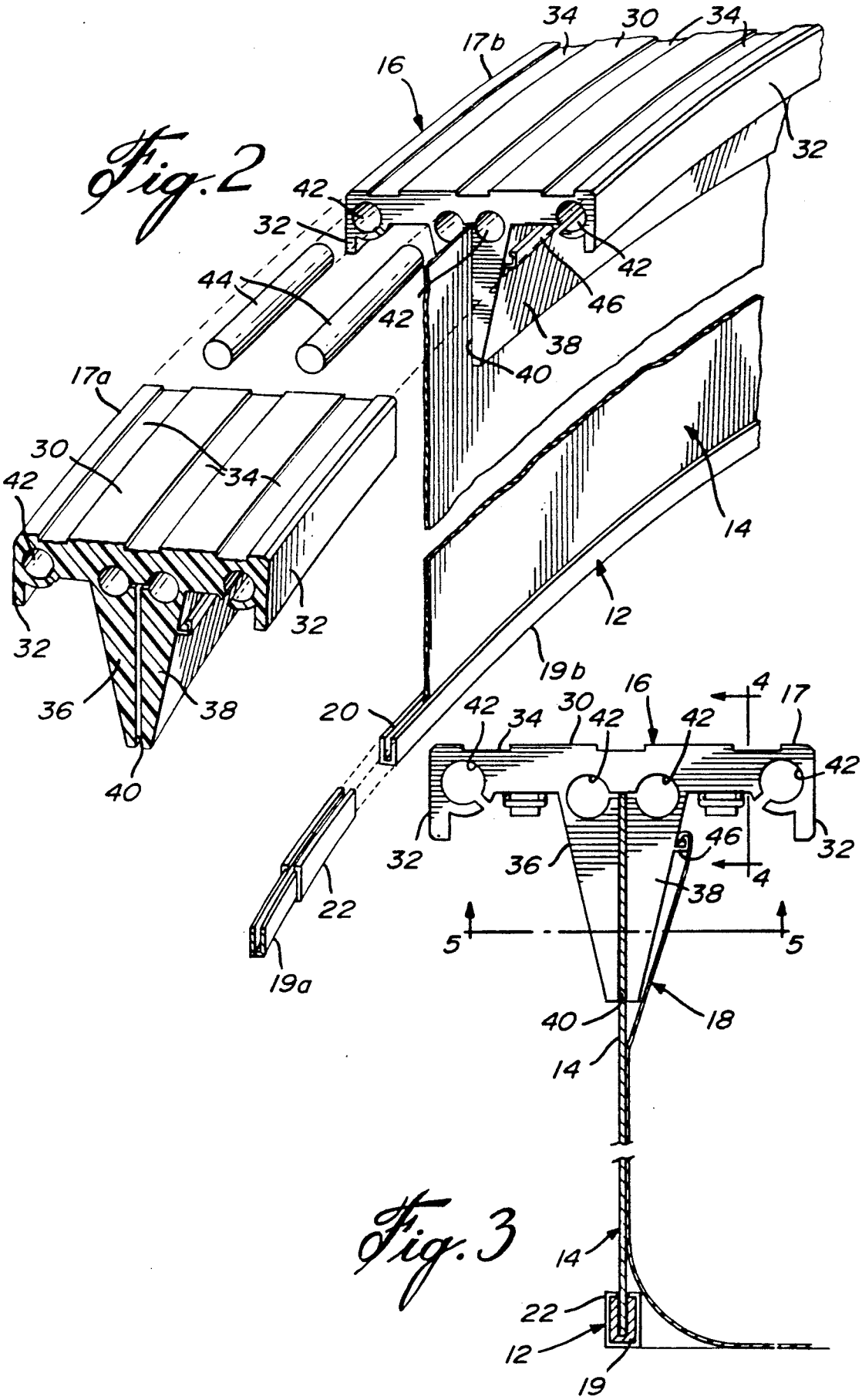
FIG. 2 is a fragmentary enlarged exploded perspective view of a detail of the present invention.
FIG. 3 is a vertical end view of a detail shown in FIG. 2.

As shown in FIGS. 2 and 3, the wall 14 is made up of an elongated strip of sheet metal. The base 12 is made up of extruded U-shaped sections 19*a*, 19*b* . . . connected together by joints 22 and defining a continuous slot or groove 20 to receive the bottom edge of the wall 14.

The coping 16 is made up of a series of coping sections 17*a*, 17*b* . . . joined together end to end as will be described. A coping section 17 includes a length of extruded plastic material extruded at a predetermined radius corresponding to the size of the pool as is required. The coping section 17 includes a ledge portion 30 and overhanging flanges 32. A pair of legs 36 and 38 extend downwardly from the ledge portion 30. The legs 36 and 38 define a narrow slot 40 therebetween. This slot 40 snugly fits over the upper portion of the wall 14.

Bores 42 are formed during the extrusion process and extend parallel to each other in the ledge portion and upper portion of the legs 36 and 38. When the coping sections 17 are joined end to end, dowels 44 are inserted in bores 42.

Figure 4:
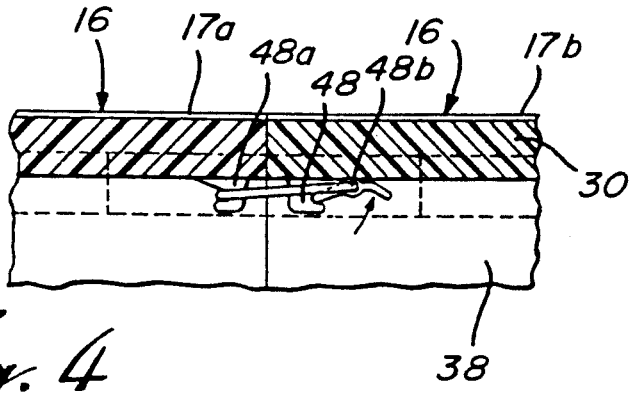
FIG. 4 is a fragmentary vertical cross-section, taken along line 4—4 of FIG. 3.
Figure 5:
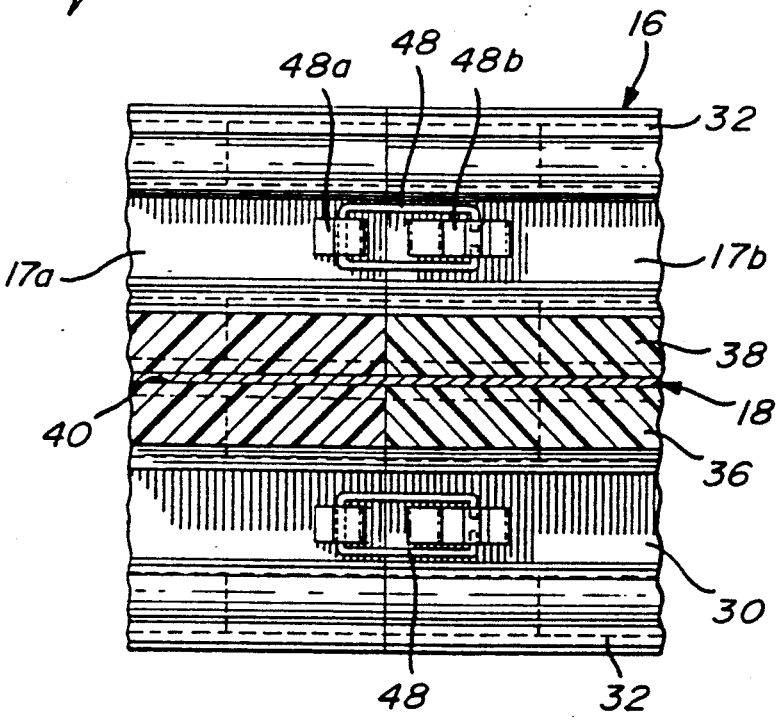
FIG. 5 is a fragmentary horizontal cross-section, taken along line 5—5 of FIG. 3, showing the detail of FIG. 4.

In addition, and as shown in FIGS. 4 and 5, locking buckles 48 are provided underneath the ledge portion 30. The locking buckles 48 have an over-center feature with a hook element 48*a* thereof on one end of the coping section 17*a* and the other portion 48*b* on an end of the coping section 17*b*. These locking buckles 48 serve to lock the coping sections 17*a* and 17*b* end to end to form the continuous coping 16. The coping sections 17 are made up of suitably rigid plastics material which has been extruded as mentioned previously. Along the leg 38 in FIGS. 2 and 3 a hook-shaped ledge 46 may be provided for anchoring the upper edge of the liner 18.

The upper edge of the liner 18 may be provided with a bead 18*a* and is reversely angled to be anchored in the ledge 46, as shown. Thus, the liner 18 is supported, but when water is present in the pool, the water pressure strains the liner 18, thereby pulling down on the ledge 46 and thus the coping 16, in order to ensure that the coping does not pop off the wall 14. This is considered an important feature since there are no fasteners attaching the coping 16 to the wall 14. The coping 16 is maintained on the wall 14 by the snug fit of the legs 36 and 38 and by the anchoring of the liner 18 to the ledge 16.

Figure 7:
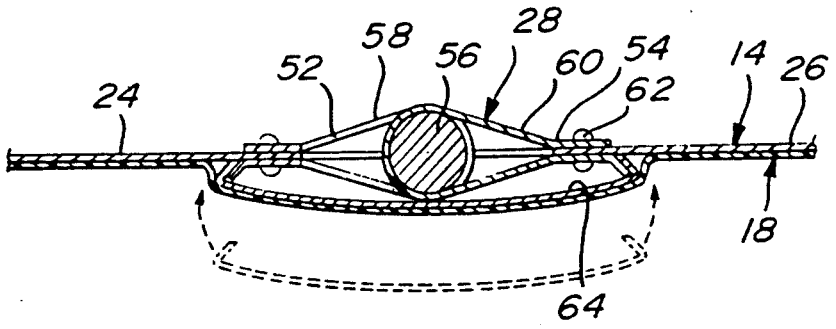
FIG. 7 is a fragmentary enlarged horizontal cross-section, taken along line 7—7 of FIG. 6.
Figure 6:
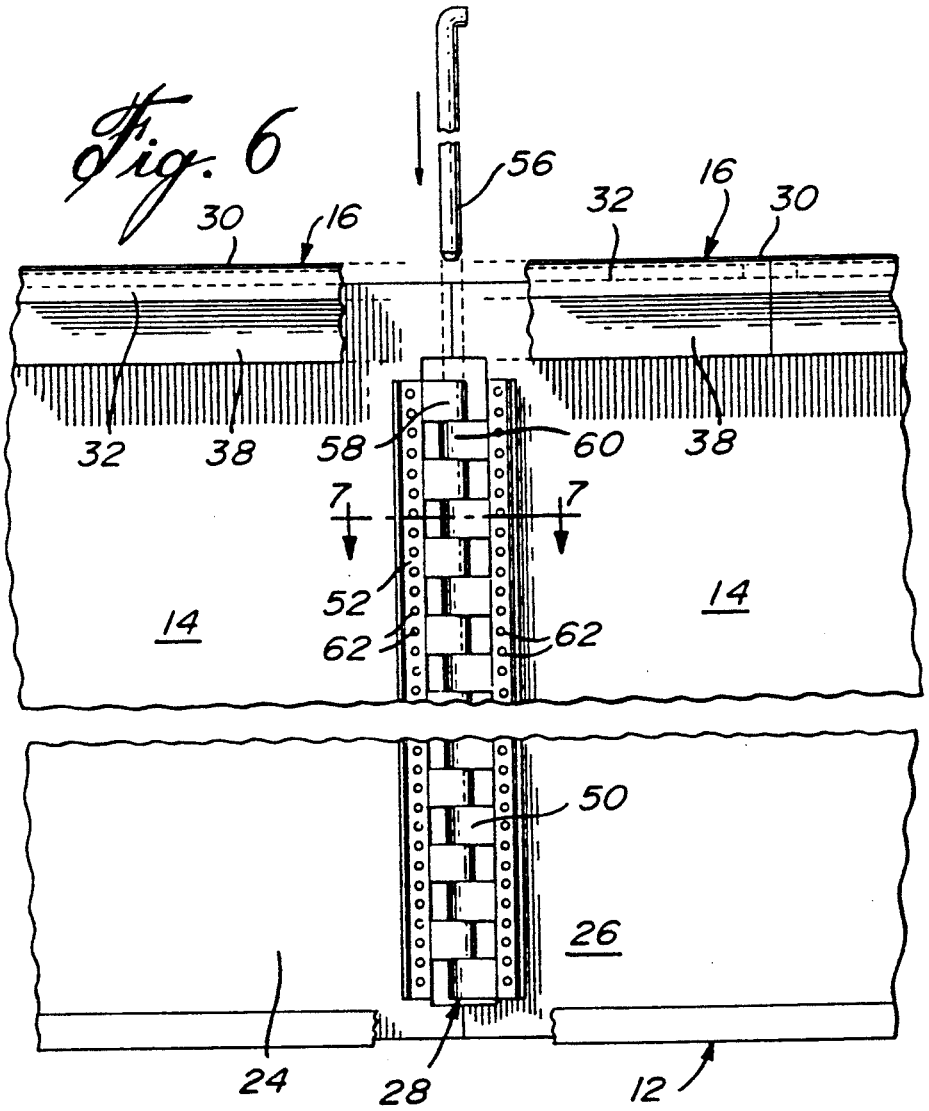
FIG. 6 is a fragmentary elevational view of a further detail of the present invention.

Referring now to FIGS. 6 and 7, there is shown a typical seam 28 joining the ends 24 and 26 of the wall 14. This seam is formed as an interdigital joint 50 having clamp strips 52 and 54 attached to the ends 24 and 26 by means of rivets 62. To the clamp strip 52 is a series of spaced-apart eyes or loops 58 while placed alternately on strip 54 are loops 60. A rod 56 is adapted to pass through the aligned loops 58 and 60 when the joint 50 is being formed.

A cover plate 64 can be snapped on to the joint in order to protect the liner 18 from the joint. A cover plate 64 could also be added to the extension of the wall 14 to provide a smooth appearance.

The kit to form the above-ground pool 10 would include a rolled-up coil of sheet metal to form the wall 14 to which the clamp strips 52 and 54 have already been riveted on the ends 24 and 26 thereof. The sheet metal strip is unrolled and in association with the base 12 is formed to a circular enclosure.

The base 12 is formed by placing base sections 19*a* and 19*b* end to end and on the bottom edge of the wall 14 by joining these base sections 19*a* and 19*b* by means of joints 22. The joint 50 is then closed by passing a rod 56 through the loops 58 and 60. The coping sections 17*a* and 17*b*... are then placed one by one on the top of the wall 14 with the top edge of the wall being snugly received in the groove 40. Each coping section 17*a* and 17*b* is joined end to end by means of the dowels 44 and the locking brackets 48, forming the coping 16 as a rigid endless ring. The liner 18 is mounted on the interior of the enclosure to form the water reservoir, and water is pumped into the reservoir.

The combination of the endless rigid coping 16 and the endless sheet metal wall 14 provides a stable upstanding wall, particularly when water is received in the reservoir. Accordingly, posts are unnecessary since the wall 14 and coping 16 are self-supporting and thus the above-ground pool is a frameless pool. The advantage of this frameless pool is the reduction in the number of parts required to mount the above-ground pool. As can be seen, no fasteners are required for the assembly of the base or the wall 14, and the only fasteners required for the coping are the locking brackets which are integral with the ends of the coping sections 17*a*, 17*b*.... The dowels 44 are easily fitted int the ends of the coping section 17*a*, 17*b*.... The dowels 44 can be fixed to one end of a coping section 17 and slid into the other end.

I claim:

1. An above-ground pool support structure comprising a closed base member having an upwardly opening wall receiving groove, a continuous wall formed from an elongated, flexible tensile-strong, flat strip having parallel top and bottom linear edges a pair of linear side edges and smooth side surfaces, a seam extending vertically along the side edges of the strip when the wall is assembled on the base in said wall receiving groove, and an endless, rigid coping member defining a continuous groove for receiving the top edge of the wall in a snug manner, the endless coping member including a plurality of coping sections of constant cross-section and having cooperating buckle means at an end of each section adapted to engage a locking buckle means of an adjacent coping section so as to connect and lock ends of the coping sections together forming an endless coping.

2. An above-ground pool as defined in claim 1, wherein openings are provided in the ends of each of the coping sections for receiving elongated dowels.

3. An above-ground pool as defined in claim 1, wherein the locking buckles include over-center lever devices with one part of the buckle thereof on one end of the coping section, and a mating part of the locking buckle being provided on the other end thereof.

4. An above-ground pool as defined in claim 1, wherein the seam includes an interdigital joint having at least one clamp strip, attached to each side edge of the flat strip forming the wall, each clamp strip having interdigitated loops aligned on a joint axis, and a rod extending through the aligned loops to complete the joint.

5. An above-ground pool comprising of a closed base member, a flexible, tensile, strong, flat strip forming a wall, and an endless coping extending above the top edge of the wall with a flexible liner on the interior of the pool, the endless base member having an upwardly opening wall-receiving groove, the wall member in the form of a flat strip having parallel top and bottom linear edges a pair of linear side edges, a seam extending vertically at the ends of the strip when the wall is assembled on the base in said wall receiving groove, and an endless rigid coping member made up of a plurality of coping sections of constant cross-section, each section having ends, a top portion and downwardly extending coextensive legs with parallel opposed surfaces forming a narrow groove therebetween for receiving the wall in a snug manner such that the surfaces of the grooves are in intimate contact with the side surfaces of the wall, the ends of the coping sections each having cooperating locking means adapted to mate and lock with cooperating locking means on respective ends of adjacent coping sections, a continuous hook-shaped ledge mounted on an inner of the downwardly extending legs, the hook-shaped ledge open towards the top, and the liner provided with an upper bead adapted to engage in the hook-shaped ledge so that when water is provided in the pool, the liner will pull down on the hook-shaped ledge thereby securing the endless coping on the top edge of the wall.

6. An above-ground pool construction as defined in claim 5, wherein the tensile-strong strip is an elongated flexible sheet metal strip with joint members at each end thereof adapted to be joined together to form the seam.

* * * * *